United States Patent [19]

Smolyanitsky et al.

[11] 4,205,727

[45] Jun. 3, 1980

[54] CLAMPING MEANS FOR A DEVICE FOR DRIVING FLEXIBLE ROD-SHAPED ELEMENTS IN SOIL

[76] Inventors: Boris N. Smolyanitsky, ulitsa Oleko Dundicha, 27, kv. 18; Vladimir P. Boginsky, ulitsa Lenina, 59, kv. 58; Alexei D. Terskov, ulitsa Bljukhera, 21, kv. 74; Vasily V. Mukhaev, ulitsa Dmitria Donskogo, 29, kv. 16, all of Novosibirsk, U.S.S.R.

[21] Appl. No.: 866,865

[22] Filed: Jan. 4, 1978

[51] Int. Cl.[2] ..... E21B 1/02

[52] U.S. Cl. ..... 173/55; 24/263 CA

[58] Field of Search ..... 24/263 A, 263 D, 263 CA; 173/55; 166/77; 254/29 R

[56] References Cited

U.S. PATENT DOCUMENTS

| | | | |
|---|---|---|---|
| 296,804 | 4/1884 | Wells | 173/55 |
| 370,744 | 9/1887 | Mixer | 24/263 CA |
| 498,313 | 5/1893 | Sime | 173/55 |
| 1,621,286 | 3/1927 | Sooy | 24/263 CA |
| 2,274,273 | 2/1942 | Miller | 24/263 CA |

FOREIGN PATENT DOCUMENTS

| | | | |
|---|---|---|---|
| 492154 | 4/1953 | Canada | 24/263 CA |
| 211845 | 7/1909 | Fed. Rep. of Germany | 24/263 CA |
| 652546 | 4/1951 | United Kingdom | 24/263 CA |

*Primary Examiner*—William E. Lyddane

*Attorney, Agent, or Firm*—Robert E. Burns; Emmanuel J. Lobato; Bruce L. Adams

[57] ABSTRACT

The invention contemplates a clamping means for a device for driving flexible rod-shaped elements in soil, wherein an open-ended tapered inner space of the casing accommodates at least two wedging elements and a spring urging the wedging elements into the engagement with the casing and with a rod being driven. The casing is externally provided with lugs having holes receiving pivots which support rocker arms each having a free end and the other end extending in an aperture of the casing wall and engaging one of the wedging elements.

3 Claims, 6 Drawing Figures

CLAMPING MEANS FOR A DEVICE FOR DRIVING FLEXIBLE ROD-SHAPED ELEMENTS IN SOIL

BACKGROUND OF THE INVENTION

The present invention relates to the construction industry, and more particularly to clamping means for a device for driving flexible rods in soil.

The invention may be used for driving elongate rod-shaped elements in soil. The use of this invention is most advantageous for driving rod-shaped elements having a low longitudinal rigidity, such as ground electrodes, anchors, filter tubes and the like.

The volume of work associated with driving rod-shaped elements in soil in industrialized countries is very important and is increasing.

Thus a problem arises of providing special devices for driving rod-shaped elements in soil and development of clamping means for transmitting forces from the driving device to the element being driven.

In driving rod-shaped elements of a considerable longitudinal rigidity, a driving device is mounted on the upper end face of the element being driven. This method is unsuitable for driving rod-shaped elements having a low longitudinal rigidity since the rod-shaped element may loose its stability and be deformed under the action of driving load.

In order to perform the driving process, rods having low longitudinal rigidity are cut into portions, each portion being of a length permitting the driving to be made with the action of driving load on the upper end face thereof without a loss of stability and, as the driving proceeds, these portions are connected to one another, to obtain a required length, by welding, using threaded or other couplings. This increases labour-consumption of the driving process and prolongs the driving time.

At present there is known a clamping means for a device for driving ground electrodes and like elements in soil (cf. USSR Inventor's Certificate No. 248553, E 02 D 7/20) comprising a casing provided with an open-ended tapered inner space accommodating wedging elements and a spring ensuring the engagement of the wedging elements with the casing and rod being driven. The known clamping means is used in combination with a hydraulic power cylinder which is fastened by means of collars to an electric transmission line tower and forces the rod deep into soil when fluid is fed to the upper chamber of the hydraulic cylinder and repositions the clamping means when the fluid is fed to the lower chamber of the cylinder.

The known clamping means ensures clamping of the driven rod when a force acting from the top is applied to the casing. This force is developed due to feeding of fluid to the upper chamber of the driving hydraulic cylinder. A reaction force which thus appears is directed towards lifting the casing of the hydraulic cylinder. In order that such movement could not take place, the casing of the hydraulic cylinder is fixedly connected to the electric transmission line tower which takes up the reaction force. When the clamping means approaches the soil surface, the rod clamped by the wedging elements should be released, and the clamping means should be moved up along the rod at a certain height to perform the next driving cycle. For that purpose, fluid is fed to the lower chamber of the hydraulic cylinder. Thus the piston of the hydraulic cylinder moves up and entrains with it the casing of the clamping means. The wedging elements move apart and release the rod. The rod is prevented from lifting by the forces of cohesion with the soil, and the clamping means moves along the rod.

When the piston attains the utmost position, the fluid is fed to the upper chamber of the hydraulic cylinder. The piston starts moving down. The clamping means jams the rod, and the driving continues.

Therefore, the prior art clamping means enables a static forcing of the rod deep into soil, and requires a force for releasing the rod to be applied from the bottom up, which force is developed when fluid is fed to the lower chamber of the hydraulic cylinder.

The disadvantage of the known clamping means consists in that it cannot be used for driving rods with the employment of vibratory or impact mechanisms since reactive forces occurring during operation of such mechanisms cannot ensure the release of the rod as they are very small.

Also known in the art is a clamping means for a device for driving elongate rod-shaped elements in soil (cf. USSR Inventor's Certificate No. 279450, E 20 D 9/02) comprising a casing, a lifting gear and a vibrator mounted in the upper portion of the device. The casing of the clamping means accommodates two tapered sleeves having the smaller bases of their tapering inner spaces facing each other. The tapering inner spaces of the tapered sleeves accommodate spring-biased wedging elements in the form of balls separated by means of two cages: an upper cage and a lower cage. The upper cage is connected by means of a pin to one end of a rocker arm having the other end provided with sockets in which there are fixed springs and to which there is connected a rope of the lifting gear.

When suspended the vibrator, with the clamping means fixed thereto, is supported with the rocker arms on weights fastened to the ropes. The springs are compressed by the amount of the rocker arm stroke, and the upper cage and the balls of the upper tapered sleeve are lifted so that the clamping means is released. The rod is passed through the hole of the vibrator, and the clamping means is lowered until it bears against the soil. When the tension from the lifting ropes is released, the rod is clamped under the action of gravity of vibrator and under the action of the springs urging the balls against the rod. Thus, the balls of the lower tapered sleeve take up and transmit to the rod the driving force, and the balls of the upper sleeve take up the reactive force from the vibrator and prevent the entire clamping means from lowering or lifting, respectively, along the rod. Upon switching the vibrator on, the driving of the rod begins. When the clamping means approaches the soil surface, to release the rod being driven and to re-position the vibrator and the clamping means to a height anew, the lifting gear is put on. The rocker arms displace the upper cage and release the rod.

The disadvantages of the prior art clamping means consist in the use of two tapered sleeves and self-wedging devices each consisting of the tapered sleeve, cage and balls, which makes the construction complicated, in heavy weight and large size of the clamping means, as well as in the need to employ a lifting gear for the release of the rod and re-positioning of the driving device therealong.

Known in the art is also a clamping means for a device for driving earthing electrodes in soil (cf. USSR Inventor's Certificate No. 376525, E 02 D 7/18) comprising a casing having an open-ended tapered inner space, which is made integral with a movable spring-biased anvil. Wedging elements and a spring ensuring their engagement with the casing of the clamping means and with the rod are accommodated in the inner space of the clamping means. The driving device comprises an impact device suspended to a base tractor. An auxiliary holder is mounted on the impact device co-axially with the main clamping means. The rod is passed through the holder and the clamping means until it bears against the soil. A hammer piston of the impact device imparts a blow to the movable anvil. The clamping means will then clamp the rod and move together therewith downwards. Concurrently with the driving of the rod, the return spring is compressed. When the hammer piston moves back upwards for imparting the next blow, the return spring lifts the anvil with the clamping device back into the initial position.

The disadvantages of the prior art clamping means consist in insufficient strength of the movable anvil of the device which is integral with the casing of the clamping means and takes up an off-set impact load, hence in low reliability and short service life.

SUMMARY OF THE INVENTION

It is an object of the invention to eliminate the above-mentioned disadvantages.

Another object of the invention is to provide a construction of the clamping means which enables the driving of rod-shaped elements of low longitudinal rigidity in soil as well as an automatic re-positioning of the driving device and the clamping means.

The above objects are accomplished by that in a clamping means for a device for driving elongate rod-shaped elements in soil comprising a casing having an open-ended tapered inner space accommodating at least two wedging elements and a spring ensuring the engagement of the wedging elements with the casing and rod, according to the invention, the casing is externally provided with lugs having holes for installation of pivots on which there are mounted rocker arms each having one end which is free and the other end which extends in an aperture made in the side wall of the casing to engage the wedging element.

This construction of the clamping means enables rod-shaped elements having low longitudinal rigidity to be driven in soil, provides for an automatic re-positioning of the driving device without the employment of auxiliary lifting gears by using a reactive force of rebound of the driving device, and simplifies the manufacture, improves reliability and prolongs service life.

The casing lugs are preferably provided in the lower portion thereof, and each rocker arm have one end received in an opening made in the lower portion of the wedging element.

This construction of the clamping means enables the reduction of its width and facilitates the manufacture of the casing.

The casing lugs are preferably provided in the middle portion of the casing, and the rocker arms have their ends received in grooves made on the outer surfaces of the wedging elements.

This construction of the clamping means enables the reduction of its height, lowers its weight and ensures the clamping of a large range of sizes of rod-shaped elements.

The casing lugs are preferably provided in the upper portion thereof, and the rocker arms are mounted with their ends located at the upper end faces of the wedging elements.

This construction of the clamping means facilitates its manufacture and improves the strength of the wedging elements.

BRIEF DESCRIPTION OF THE DRAWINGS

The invention will now be described with reference to specific embodiments thereof illustrated in the accompanying drawings, in which.

DESCRIPTION OF THE PREFERRED EMBODIMENT

The reference in now made to several specific examples of the construction of the clamping means for a device for driving elongate rod-shaped elements in soil, having:

(a) lugs provided on the lower portion of the casing and wedging elements having openings in their lower portion;

(b) lugs provided on the middle portion of the casing and wedging elements having groves made on the outer surfaces thereof;

(c) lugs provided on the upper portion of the casing.

Figure 1:
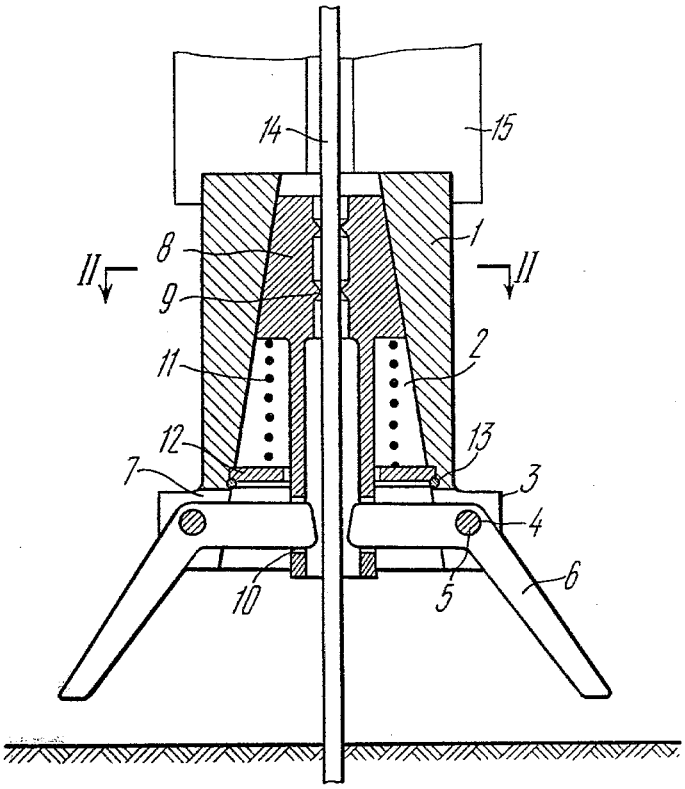
FIG. 1 shows the clamping means for a device for driving elongate rod-shaped elements in soil, in which the casing lugs are provided in the lower portion of the casing.
Figure 2:
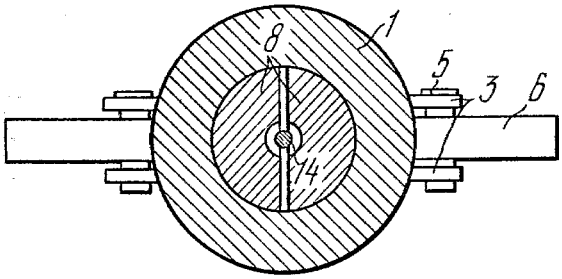
FIG. 2 is a sectional view taken along the line II—II in FIG. 1.

The clamping means for a device for driving flexible rod-shaped elements comprises a casing 1 (FIGS. 1,2) provided with an open-ended tapered inner space 2. The outer surface of the casing 1 is provided, in the lower portion thereof, with pairs of lugs 3 which are made integral with the casing or connected thereto by welding and have each a hole 4. Pivots 5 are received in the holes 4 of the lugs 3 to support rocker arms or activators 6. Apertures 7 are made in the side wall of the casing 1 opposite each pair of lugs 3. The tapered inner space 2 of the casing 1 accommodates two wedge-shaped wedging or gripping elements 8 each comprising a half sleeve having a tapered outer surface in the upper portion thereof and a cylindrical surface in the lower portion. The wedging elements are internally provided with pointed radial projections 9 and have openings 10. The wedging elements 8 are urged towards the utmost position by a spring 11 which bears against a washer 12 and an expansion ring 13 locking the washer 12 in the inner space 2. Each rocker arm 6 mounted on the pivot 5 has one end extending in the aperture 7 of the casing 1 and received in the opening 10 of the wedging element 8. A rod 14 being driven is passed through the clamping means is such a manner that the wedging elements 8 embrace it with their pointed projections 9. The casing 1 of the clamping means is fixedly connected to a pneumatic impact driving device 15.

The clamping means operates in the following manner. A driving device, such as the pneumatic impact device with the clamping means is held vertically. The clamping means bears against the soil surface with its rocker arms or levers 6 each have an arm connected to a corresponding gripping element which cause the wedging elements 8 to move down to enlarge the clearance between them. The rod 14 is inserted through the pneumatic impact driving device 15 from the top and is passed through the clamping means until it bears against the soil surface. Then, holding the rod 14, the pneumatic impact driving device 15 with the clamping means is lifted to a height of 0.5–0.7 m above the soil surface. The wedging elements 8 are urged by the spring 11 to the atmost position until their projections 9 touch the rod 14. Under the gravity of the pneumatic impact driving device 15 and the clamping means, the wedging elements 8 clamp the rod 14 and hold the pneumatic impact driving device 15 from sliding down along the rod 14. Upon switching on of the pneumatic impact device 15, the hammer piston imparts blows which are transmitted to the clamping means rigidly connected to the pneumatic impact device. Under the action of blows, the casing 1 of the clamping means tends to move down. The wedging elements 8 touching the rod 14 slide over the tapered surface of the inner space 2 to move towards each other and to clamp the rod 14. Under the action of the reaction force of rebound, the pneumatic impact device 15 with the clamping means tends to move up along the rod. However, forces required to release the clamping means exceed the rebound force, and the clamping mechanism cannot be moved.

Under the action of blows, the rod 14, together with the pneumatic impact driving device 15 and the clamping means, is driven in soil. When the clamping means approaches the soil surface, the rocker arms 6 each have a leg outside the casing and bear with their free ends of the leg against the soil and rock about the pivots 5, while the ends of the arms received in the openings 10 of the wedging elements 8 push these elements down to enlarge the clearance therebetween and release the rod 14.

At the moment of release of the rod 14 the reactive force of rebound of the pneumatic impact driving device 15 causes the impact device and the clamping means to jump up along the rod at a height of 0.2–0.5 m above the soil surface. The next blow of the hammer piston will clamp the rod 14 in the clamping means anew, and the rod will be driven further. Then the above-described cycle continues until the rod is completely driven deep in soil.

Therefore, the above-described clamping means enables rod-shaped elements of low longitudinal rigidity to be driven in soil with the employment of impact or vibratory mechanisms and ensures an automatic re-positioning of the driving device without using any auxiliary lifting gear.

According to another embodiment, the clamping means comprises a casing 16 (FIGS. 3,4) provided with an open-ended tapered inner space 2. The casing 16 is externally provided, in the middle portion thereof, with two pairs of lugs 17 which are integral with the casing or welded thereto. Each lug 17 has the hole 4 with the pivot 5. Apertures 18 are provided in the side wall of the casing 17 opposite each pair of the lugs 17. The pivots 5 support rocker arms 19. The tapered inner space 2 of the casing 16 accommodates two wedging elements 20 each comprising a half sleeve having an outer tapered surface and an inner cylindrical surface. The wedging elements are internally provided with pointed radial projections 21. The outer surfaces of the wedging elements 20 are provided with groovers 22. Each rocker arm 19 has one end extending in the aperture 18 of the casing 16 and received in the groove 22 of the wedging elements 20. The wedging elements 20 are urged towards the utmost position by the spring 11 which bears against the washer 12 and the expansion ring 13 which locks the washer 12 in the inner space 2. The rod 14 being driven is passed through the clamping menas in such a manner that the wedging elements 20 embrace it with their pointed projections 21. The casing 16 of the clamping means is fixedly connected to the pneumatic impact driving device 15.

This embodiment of the clamping means is preferably used for driving in soil rods of low rigidity having an arcuate axial shape and variable cross-section.

Figure 3:
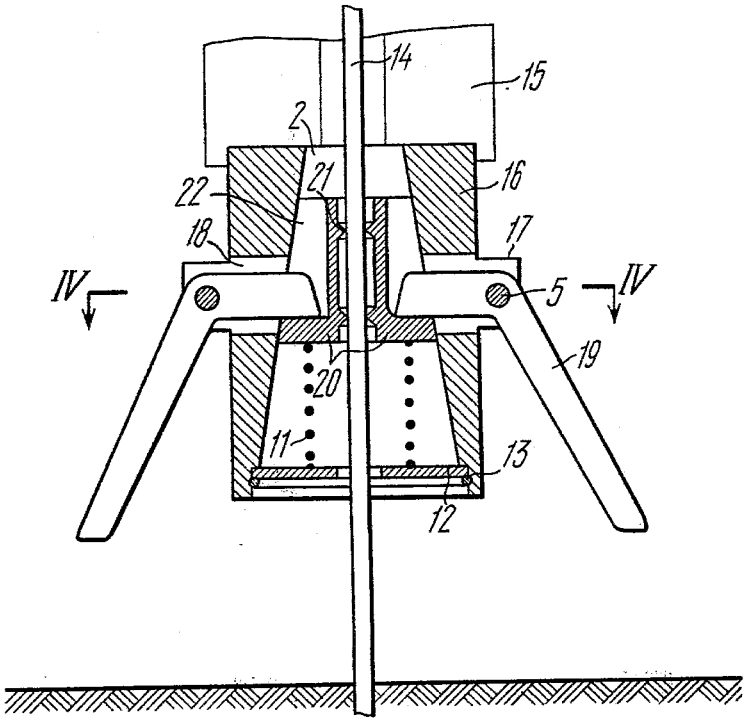
FIG. 3 shows the clamping means in which the casing lugs are provided in the middle portion of the casing.
Figure 4:
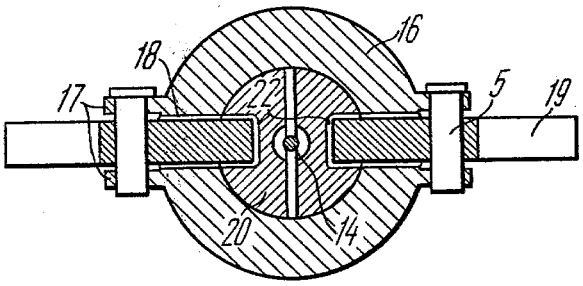
FIG. 4 is a sectional view taken along the line IV—IV in FIG. 3.

The operation of the clamping means shown in FIGS. 3, 4 differs from that of the clamping means in accordance with the first embodiment in the following.

When the clamping means approaches the soil surface, the free ends of the rocker arms 19 bear against the soil, and the arms rock about the pivots 5, while the other ends extending in the apertures 18 and received in the groovers 22 of the wedging elements 20 push the wedging elements down to enlarge the clearance therebetween and release the rod 14. At the moment of release of the rod 14 the reactive force of rebound of the pneumatic impact device 15 causes the device with the clamping to jump up along the rod to a height of 0.2–0.5 m above the soil surface, the next blow of the hammer piston clamps the rod 14 in the clamping means anew, and the driving continues.

Another embodiment involves the clamping means comprising a casing 23 (FIGS. 5,6) having an open-ended inner space 2. The casing 23 is externally provided, in the upper portion thereof, with two pairs of lugs 24 integral with the casing 23 or welded thereto. Each lug has the hole 4 with the pivot 5. The side wall of the casing 23 has apertures 25 opposite each pair of the lugs 24. The pivots 5 support rocker arms 26. Two wedging elements 27 are accommodated in the inner space 2 of the casing 23 each comprising a half sleeve having a tapered outer surface and a cylindrical inner surface. The wedging elements 27 are internally provided with pointed projections 28. Each rocker arm 26 has one end extending in the aperture 25 of the casing 23 and located at the upper end face of the wedging element 27. The wedging elements 27 are urged towards the utmost position by the spring 11 which bears against the washer 12 and the expansion ring 13 locking the washer 12 in the inner space 2. The driven rod 14 is passed through the clamping means so that the wedging elements 27 embrace it with their pointed projections 28. The casing 23 of the clamping means is fixedly connected to the pneumatic impact driving device 15.

This embodiment of the clamping means is advantageous for driving flexible rods having an arcuate axial shape and variable cross-section in dense and frozen soils since the wedging elements 27 are stronger.

Figure 5:
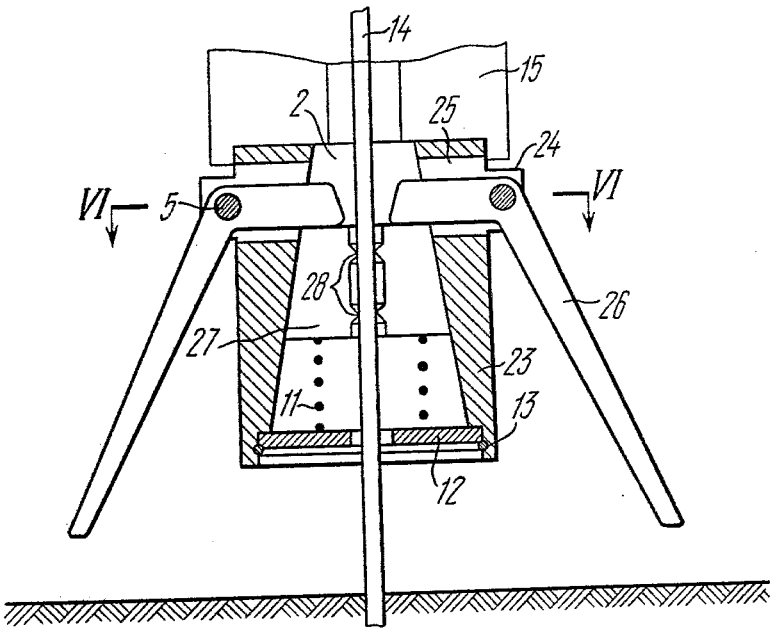
FIG. 5 is a clamping means in which the casing lugs are provided in the upper portion thereof.
Figure 6:
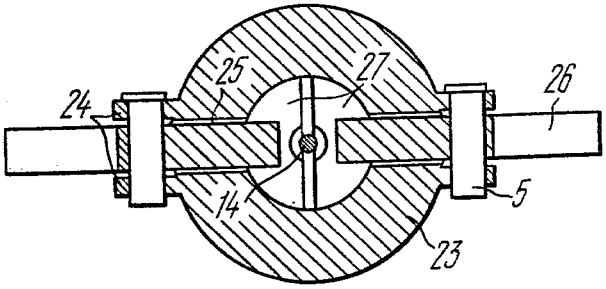
FIG. 6 is a sectional view taken along the line VI—VI in FIG. 5.

The operation of the clamping means shown in FIGS. 5, 6 differs from that of the embodiments described above in the following.

When the clamping means approaches the soil surface, the rocker arms 26 bear against the soil with their free ends and rock about the pivots 5, while the other ends of the rocker arms extending in the apertures 25 of the casing 23 and located at the upper end faces of the wedging elements 27 push the wedging elements down to enlarge the clearance therebetween and release the rod 14.

In the remaining aspects, the operation of the clamping means is the same.

Therefore, the clamping means for a device for driving flexible rod-shaped elements in soil according to the invention enables the driving of flexible rod-shaped elements by applying an axial driving load to the periphery of the rod-shaped element, rather than to the upper end face thereof, at a height enabling an efficient driving of the rod-shaped element without a loss of its longitudinal stability, and ensures an automatic re-positioning of the driving device on the rod, as it is driven, by using the driving action and the reaction force of rebound, to a height required for an efficient driving of the rod without loss of longitudinal stability. Compared to conventional clamping means for driving rods of low rigidity, the clamping means according to the invention permits the lifting gears to be dispenses with, is simpler in construction and manufacture.

What is claimed is:

1. Apparatus for clamping a rod driven axially into the ground comprising; a casing having a tapered bore, wedge-shaped gripping elements in said bore biased toward a direction in said tapered bore so that the gripping elements are moved toward each other to a gripping position for gripping a rod received axially in said bore and extending axially between the gripping elements and releasably held therebetween, biasing means biasing the gripping elements toward a smaller cross section of the bore to effect said gripping of the rod, a pair of actuators pivotally mounted on said bore for actuating said gripping elements axially in said bore in a direction away from and opposite to said first-mentioned direction to move the gripping elements toward a larger part of said bore so that the gripping elements separate a greater extent and release said rod, said actuators having legs extending from said casing for contacting the ground and being actuated pivotally upwardly to effect the actuation of the gripping elements to effect release of said rod and said casing having means for attaching the casing to a reciprocatory driver for movement of the casing downwardly while gripping said rod thereby to drive the rod axially into the ground and for moving the casing upwardly from the ground to effect release between the gripping elements and the rod when said legs engage the ground, whereby the casing is effective to drive the rod into the ground under control of said driver and is movable upwardly axially thereon by rebound of said driver under intervals when said rod is not being gripped.

2. Apparatus for clamping a rod driven axially into the ground according to claim 1, in which said biasing means comprises a compressible spring.

3. Apparatus for clamping a rod driven axially into the ground according to claim 2, in which said actuators each comprise a lever each having an arm connected to a corresponding gripping element in said casing and said leg extending outwardly of said casing.

* * * * *